US005582002A

United States Patent [19]

Pattas

[11] Patent Number: 5,582,002

[45] Date of Patent: Dec. 10, 1996

[54] METHOD OF AND AN APPARATUS FOR CONTROLLED REGENERATION OF A DIESEL SOOT FILTER

[76] Inventor: Konstantin Pattas, Abelonon 73, 55535 Thessaloniki, Greece

[21] Appl. No.: 453,524

[22] Filed: May 30, 1995

[30] Foreign Application Priority Data

Jun. 29, 1994 [DE] Germany ..... 44 22 829.5
Feb. 28, 1995 [DE] Germany ..... 195 06 983.8

[51] Int. Cl.[6] ..... F01N 3/02

[52] U.S. Cl. ..... 60/274; 60/288; 60/277; 60/311

[58] Field of Search ..... 60/274, 277, 278, 60/286, 288, 311; 251/11; 55/DIG. 30, 455

[56] References Cited

U.S. PATENT DOCUMENTS

| | | | |
|---|---|---|---|
| 1,792,891 | 2/1931 | Clifford | 251/11 |
| 3,961,478 | 6/1976 | Lange | 60/288 |
| 4,318,529 | 3/1982 | Huelle et al. | 251/11 |
| 5,067,318 | 11/1991 | Arai | 60/288 |
| 5,144,796 | 9/1992 | Swars | 60/288 |
| 5,195,318 | 3/1993 | Shinzawa et al. | 60/288 |
| 5,195,319 | 3/1993 | Stobbe | 60/311 |
| 5,489,319 | 2/1996 | Tokuda et al. | 60/286 |

FOREIGN PATENT DOCUMENTS

| | | |
|---|---|---|
| 3806219 | 9/1989 | Germany . |
| 57-195815 | 12/1982 | Japan . |
| 3-85315 | 4/1991 | Japan . |
| 663253 | 9/1987 | Switzerland . |

*Primary Examiner*—Leonard E. Heyman
*Attorney, Agent, or Firm*—Rogers & Killeen

[57] ABSTRACT

With a method of controlled regeneration of a diesel soot filter of a diesel engine the diesel soot filter is divided into a plurality of sections which are connected in parallel in the exhaust gas tract and into at least one of which the influx of exhaust gas is blocked in response to the exhaust gas temperatures measured downstream of the diesel soot filter. When the maximum admissible exhaust gas temperature downstream of the diesel soot filter is exceeded this section, consequently, is shut off in part or even completely from the exhaust gas stream so that the mass flow rate through the corresponding filter section is reduced or even cut off, while the mass flow rate through the remaining sections is increased in a way so as to again control the regeneration or even discontinue it.

20 Claims, 2 Drawing Sheets

METHOD OF AND AN APPARATUS FOR CONTROLLED REGENERATION OF A DIESEL SOOT FILTER

FIELD OF THE INVENTION

The invention relates to a method of and an apparatus for controlled regeneration of a diesel soot filter of a diesel engine.

BACKGROUND OF THE INVENTION

It is known that diesel soot filters having a porous wall permit gaseous components of the exhaust gas to pass, while they prevent the passage of solid particles which result, above all, from coagulation of carbon molecules and heavy hydrocarbons.

The soot particles deposited in the diesel soot filter and, in the course of operation, progressively clogging the diesel soot filter can be decomposed by thermal (burning), catalytic, or other processes to regenerate the diesel soot filter.

Thermal regeneration with the engine running, e.g. during operation of a vehicle equipped with the same, may cause an uncontrolled rise of the reaction speed of the combustion of the particles collected in the diesel soot filter under stochastic conditions when the regeneration is released automatically. That may lead to an inadmissible temperature increase and result in partial or total fusion or destruction of the diesel soot filter.

It has been suggested to measure the temperature of the exhaust gas downstream of the diesel soot filter (DE 38 06 219 A1) to avoid uncontrolled combustion. If a predetermined maximum admissible temperature is exceeded in this case valves upstream and downstream of the diesel soot filter are actuated by means of an electronic unit so that all of the exhaust gas will be discharged through a bypass circumventing the diesel soot filter. Thus the diesel soot filter, temporarily, is disconnected entirely from the exhaust gas stream.

Although operation through the by pass makes up only a small percentage of the overall operating time of the engine, muffling equipment is need to dampen the annoying noise which is created during the bypass operation. Moreover, it is undesirable from the ecological point of view to discharge unscrubbed exhaust gases without filtering into the atmosphere even for a short time, as occurs in bypass operation.

It is likewise known (CH 663 253 A) to divide a particle filter in the exhaust gas tract of an internal combustion engine, especially one with exhaust gas supercharging, into two sections connected in parallel, namely one thermally well insulated "high temperature flow zone" and one "low temperature flow zone". By means of a control flap, exhaust gas will flow through the low temperature flood only at low engine load and through both flow zones at high engine load, by corresponding adjustment of the control flap. The results hereof, apart from frequent particle combustion, is that the exhaust gas supercharger connected downstream of the exhaust gas tract always is fed quickly with exhaust gas of sufficient temperature in order to prevent the so-called "turbo hole" upon depression of the accelerator pedal. However, protection against uncontrolled burn off of deposited particles in the flow zones cannot be achieved by the measure according to the Swiss patent.

SUMMARY OF THE INVENTION

It is the object of the invention to indicate a method and an apparatus to regenerate diesel soot filters in diesel engines with which effective protection against damage or destruction of the diesel soot filter can be achieved in simpler manner than before and under avoidance of the inconveniences of bypass operation.

A method according to claim 1 and an apparatus according to claim 2 serve to solve that problem.

According to the invention, the diesel soot filter is divided into a plurality of sections which are connected in parallel in the exhaust gas flow and of which at least one is adapted to be shut off totally or in part from the exhaust gas stream in response to the particular exhaust gas temperature prevailing at the outlet of the respective section.

While the reaction in the isolated section is reduced or interrupted, the mass flow rate through the remaining section or sections not disconnected of the diesel soot filter is increased. Hereby the reaction speed of the thermal regeneration in these remaining sections is reduced.

If the maximum admissible temperature should be surpassed also in one of the remaining sections not shut down of the diesel soot filter then this section, too, will be disconnected from the exhaust gas stream. This is continued in accordance with the invention until the mass flow rate through at least the last remaining section of the diesel soot filter has risen to such a degree that the reaction which was started will be broken off or "extinguished".

In this manner effective protection is provided against damage or destruction of the diesel soot filter by uncontrolled combustion of the deposited particles, making a bypass and thus the emission of unfiltered exhaust gas into the atmosphere during bypass operation dispensable as well as expensive muffling equipment.

Advantageous modifications of the invention are indicated in the subclaims.

BRIEF DESCRIPTION OF THE DRAWING

The invention will be described further by way of example, with reference to the accompanying diagrammatic drawings, in which.

DESCRIPTION OF THE PREFERRED EMBODIMENTS

Figure 1:
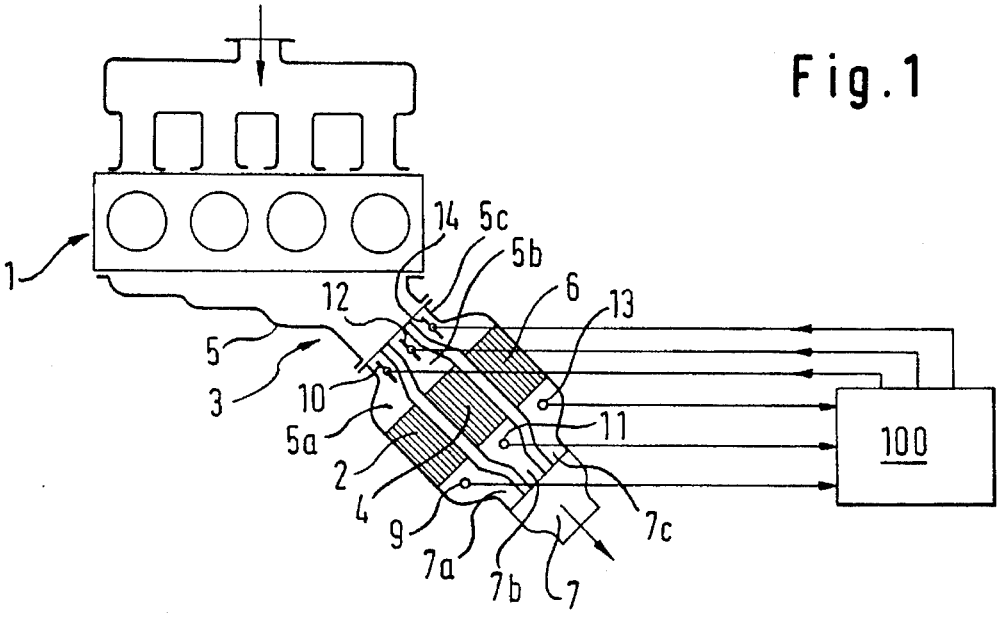
FIG. 1 shows a four cylinder diesel engine comprising a downstream diesel soot filter according to the invention in the exhaust gas tract.

FIG. 1 shows a four cylinder diesel engine 1 in the exhaust gas tract 3 of which diesel soot filters 2, 4, and 6 are installed, with no bypass being provided to bridge the diesel soot filters. These three diesel soot filters are installed parallel to each other in the exhaust gas tract 3 and comprise a common inlet 5 from which individual inlet pipe ends 5*a*, 5*b*, 5*c* are branched off, each opening into an associated diesel soot filter 2, 4, 6, and individual outlet pipe ends 7*a*, 7*b*, 7*c* which each start from a diesel soot filter 2, 4, 6 and are joined in a common outlet 7.

In the inlets 5*a*, 5*b*, 5*c*, a throttling member 10, 12, 14 each—in other words as many throttling members as diesel soot filters 2, 4, 6—are provided. Also, thermocouples 9, 11, 13 are provided in the outlets 7*a*, 7*b*, 7*c* for individually detecting the exhaust gas temperatures of the three diesel soot filters. Their output signals are input into an electronic unit 100 which controls the throttling members. The throttling members 10, 12, 14 here are designed as throttle flaps.

From time to time, soot particles deposited in the diesel soot filters are regenerated by combustion due to a temperature increase during operation or by means of exhaust gas throttling. In the case of enforced regeneration all the throttling members 10, 12, 14 are actuated simultaneously by the electronic unit 100.

That diesel soot filter 2, 4, or 6 behind which the exhaust gas temperature measured exceeds a given temperature is shut off from the exhaust gas stream by blocking the corresponding throttling member 10, 12, or 14 for protection against uncontrolled burning during regeneration. The closing of the respective inlet 5*a*, 5*b*, or 5*c* takes place totally or partly by means of the corresponding throttling member 10, 12, or 14 upon an ON/OFF signal or an analog actuating signal emitted by the electronic unit 100. This unit 100 receives the output signals of the thermocouples 9, 11, 13 as input signals.

Figure 2:
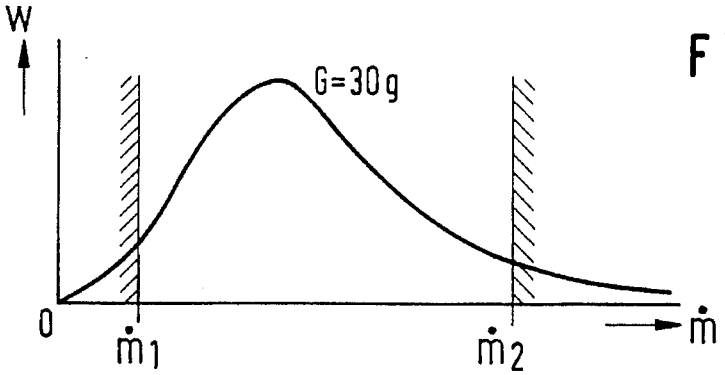
FIG. 2 is a diagram of the reaction speed of regeneration above the mass flow rate of the diesel soot filter.

The reaction speed of the combustion started of the soot accumulated in the diesel soot filter at constant exhaust gas temperature is a function of the mass flow rate m. The dependence of the reaction speed w of the combustion on the mass flow rate m is illustrated qualitatively in the form of a diagram in FIG. 2. If the temperature downstream of the diesel soot filter 2 loaded with a quantity G of particles (FIG. 1) exceeds the maximum admissible exhaust gas temperature this filter 2 is blocked partly or even totally by actuation of the corresponding throttle flap 10. And, as a consequence, the mass flow is reduced under $m_1$. Now the main exhaust gas flow rate is passed through the diesel soot filters 4 and 6. Accordingly, the mass flow rate m through these filters 4 and 6 is increased to above $m_2$. This means that the reaction speed w in all filters is reduced, as may be gathered from the diagram of FIG. 2. In the event that the exhaust gas temperature surpasses the maximum admissible value downstream another filter, e.g. downstream of filter 4, this filter is throttled or closed in the same manner as filter 2 previously. This leads to a further increase of the mass flow rate m through the filter 6 in which, therefore, the reaction speed is reduced by such an amount that a reaction possibly initiated will be broken off or "extinguished".

Normal operation of the system is resumed when the exhaust gas temperature downstream each diesel soot filter 2, 4, 6 drops below the maximum admissible value.

It is a prerequisite for full protection against uncontrolled combustion of the amount of particles deposited in the diesel soot filter that the mass flow rate in the last filter causes break-off or "extinction" of the reaction already when the diesel engine is running idle.

Thus the volume and number of diesel soot filters are determined in advance for a particular diesel engine.

Figure 3:
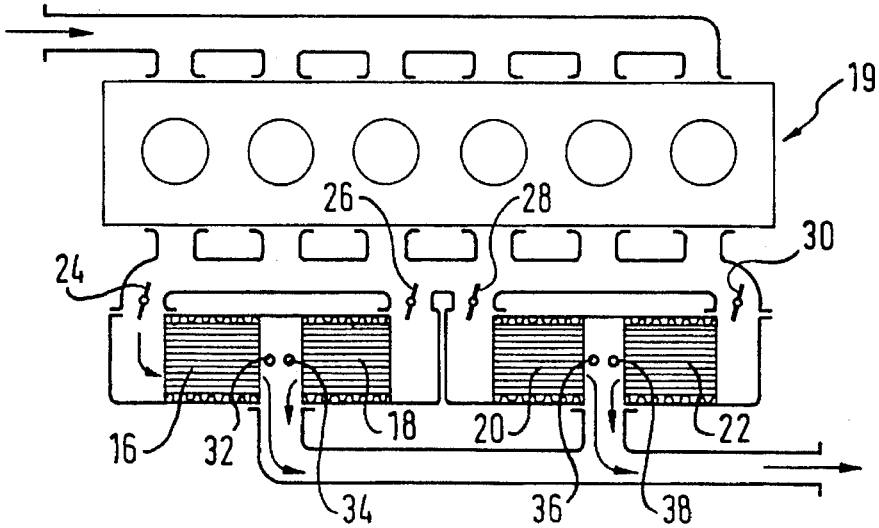
FIG. 3 shows a six cylinder engine comprising a modified diesel soot filter according to the invention.

FIG. 3 illustrates an arrangement of a six cylinder diesel engine comprising four diesel soot filters 16, 18, 20, 22. Here, too, a throttling member 24, 26, 28, 30 each in the corresponding inlets, not designated here, and a thermocouple 32, 34, 36, 38 each in the corresponding outlets, not designated here, are associated with each diesel soot filter.

The individual shutoff of the diesel soot filters from the exhaust gas stream is effected stepwise by means of the electronic unit, not shown here, in the same manner as with the embodiment according to FIG. 1, with at least one diesel soot filter being left in operation in the final stage.

The throttling members may be embodied by throttle flaps or poppet valves.

Figure 4:
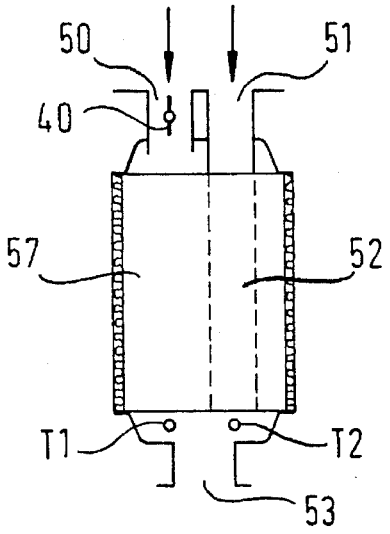
FIGS. 4, 5, and 6 illustrate further modifications of diesel soot filters according to the invention.

FIG. 4 shows a diesel soot filter with two inlets 50, 51 and consisting of a monolith. The exhaust gas is introduced through inlet 51 which does not incorporate a throttling member into section 52 of the soot filter. Exhaust gas introduced through the inlet 50 flows through section 57. This inlet 50 is provided with a throttling member 40. Corresponding thermocouples T1 and T2 are installed centrally downstream of the outlet cross sections of both sections 52 and 57.

Protection against uncontrolled combustion is warranted by actuation of the throttling member at the inlet 50, regardless of which one of the two thermocouples T1 or T2 recorded an inadmissible temperature. By virtue of the dimensioning of the tubular inlet 51, the section 52 is selected to be so small that the resulting mass flow during idle running already is so great that the combustion of the deposited soot is delayed or even interrupted.

Other than with the embodiments shown in FIGS. 1 and 3, the one illustrated in FIG. 4 (and also the embodiments according to FIGS. 5 and 6) can do with but one throttling member 40, whereby the number of movable and, therefore, sensitive parts is reduced and the structure simplified. Surprisingly, the omission of the throttling member for section 52 does not affect the forced regeneration by exhaust gas throttling.

Regeneration by particle burnoff is forced by the closing of the only blocking member 40. Thereby, an increase is obtained of the exhaust gas counterpressure and, accordingly, of the temperature upstream of both sections of the diesel soot filter.

Protection against uncontrolled burning usually becomes effective at low to medium rotational speeds or at low load. Under these circumstances the driver does not notice any deterioration of the driving characteristics due to the increased counterpressure caused by the reduced outlet area since he can push down further on the accelerator pedal to achieve the desired performance. If, on the other hand, the protection should occur in the range of maximum rotational speed or performance the protection process can be interrupted by a kickdown switch. As is known, protection against uncontrolled burning in this operating range is taken over by the cooling effect of the exhaust gas stream. By analogy, throttling that has commenced can be cancelled if the driver should demand full power.

Figure 5:
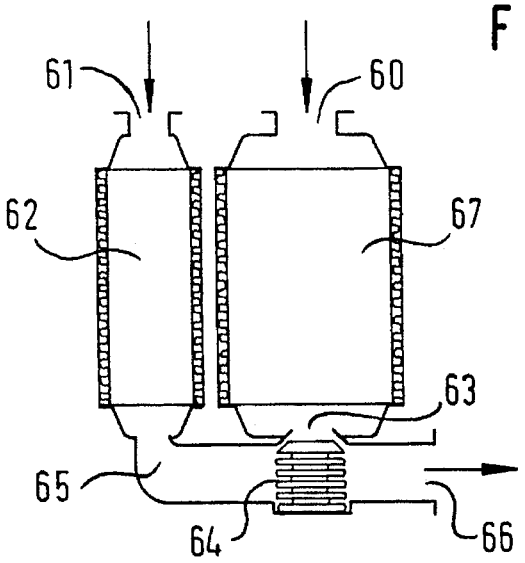

FIG. 5 shows a diesel soot filter which includes two sections, namely a bigger section 67 and a smaller one 62, and no blocking members in the inlets 60, 61. A single blocking member is embodied by a thermostat 64 which is disposed in the common outlet passage of the two sections 62, 67 and through which pass the exhaust gas streams through the sections 62, 67. When the thermostat expands it closes the outlet 63 of the greater section 67 at a predetermined exhaust gas temperature. With this embodiment, monitoring of the temperatures at the filter outlet and, therefore, an electronic control unit become superfluous since the thermostat 64 automatically takes over the protection against uncontrolled burning of both sections 62, 67 when the given exhaust gas temperature is reached.

With this embodiment the thermostat 64 consists of a closed corrugated tube which expands axially under elevated internal pressure. It is provided with a suitable filling of a substance (such as sodium) which will evaporate when a certain temperature is reached, thereby causing a quick rise of the internal pressure. Thereby, the thermostat 64 is extended elastically and the outlet 63 becomes blocked.

Figure 6:
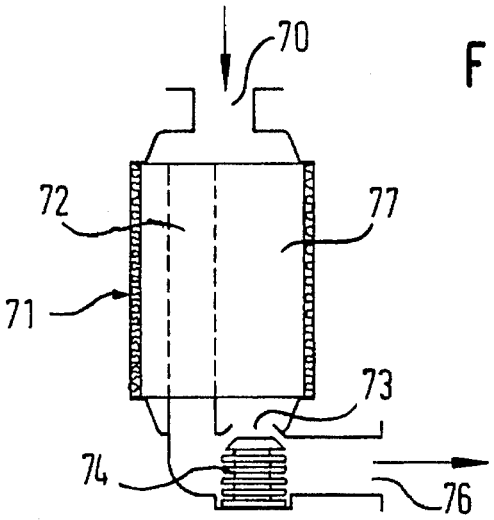

A variant of the embodiment according to FIG. 5 is presented in FIG. 6 where small and big sections 72, 77 of a filter 71 are formed as two sections of a monolith 72. Exhaust gas flows through the sections via a common inlet 70. As with the embodiment according to FIG. 5, a thermostat 74 in the form of an axially expandable corrugated tube is arranged in the outlet 73 of the great section 77 in such a way that it will automatically close the outlet 73 thereof when a predetermined temperature is reached.

What is claimed is:

1. A method of controlled regeneration of a diesel soot filter for a diesel engine in which the diesel soot filter has a plurality of sections which are connected in parallel in the exhaust gas tract of the diesel engine, the method comprising the steps of:

sensing exhaust gas temperature downstream of the sections;

throttling with a device for throttling a one of the sections an exhaust gas flow through the one section in response to the sensed exhaust gas temperature.

2. An apparatus for controlled regeneration of a diesel soot filter for a diesel engine, the apparatus comprising:

at least two filter sections connected in parallel in an exhaust gas tract of the diesel engine, a first of said filter sections having a temperature sensing means in an outlet thereof for sensing an exhaust gas temperature; and a throttling device for at least partially blocking an exhaust gas flow through said first filter section responsive to a temperature sensed by said temperature sensing means.

3. The apparatus as claimed in claim 2, wherein each of said at least two filter sections has a corresponding said throttling device in an inlet thereof and a corresponding said temperature sensing means in an outlet thereof.

4. The apparatus as claimed in claim 2, wherein a second of said filter sections does not have a said throttling device so that exhaust gas flows unobstructedly therethrough.

5. The apparatus as claimed in claim 4 further comprising a second said temperature sensing means in an outlet of said second filter section, and wherein said throttling device is further responsive to said second temperature sensing means.

6. The apparatus as claimed in claim 4, wherein said first filter section has a larger area for exhaust gas flow than said second filter section and wherein said throttling device comprises means for automatically actuating said throttling device when a predetermined exhaust gas temperature is exceeded.

7. The apparatus as claimed in claim 6 wherein said throttling device comprises a tube having a substance comprising sodium therein which evaporates when a predetermined temperature is surpassed.

8. The apparatus of claim 4 wherein said second filter section has a smaller area for exhaust gas flow than said first filter section.

9. The apparatus as claimed in claim 2 further comprising an electronic control unit for actuating said throttling device when a predetermined temperature in the corresponding outlet of the respective section is exceeded.

10. The apparatus of claim 2 wherein the exhaust gas tract has plural portions and wherein each of said filter sections is in a separate one of the plural portions.

11. The apparatus of claim 2 wherein said filter sections are part of a monolithic filter unit.

12. The apparatus of claim 2 wherein all of the exhaust gas from the diesel engine flows through said filter sections.

13. An apparatus for controlled regeneration of a diesel soot filter for a diesel engine, the apparatus comprising:

at least two filter sections which are connected in parallel in an exhaust gas tract of the diesel engine;

a throttling device in a first of said filter sections for at least partially blocking a flow of diesel engine exhaust gas therethrough, wherein the exhaust gas flows unobstructed through a second of said filter sections;

a temperature sensor in an outlet of said first filter section for sensing exhaust gas temperature and for actuating said throttling device to at least partially block said first filter section when the sensed temperature exceeds a set temperature.

14. The apparatus of claim 13 further comprising a second said temperature sensor in an outlet of said second filter section and wherein said throttling device is further responsive to said second temperature sensor.

15. The apparatus of claim 13 wherein said first filter section has a larger area for exhaust gas flow than said second filter section.

16. The apparatus of claim 13 wherein said filter sections are part of a monolithic filter unit.

17. An apparatus for controlled regeneration of a diesel soot filter for a diesel engine, the apparatus comprising at least two filter sections connected in parallel in an exhaust gas tract of the diesel engine, each of said filter sections comprising;

a filter medium for filtering soot in exhaust gas from the diesel engine;

a temperature sensor in an outlet thereof for sensing the exhaust gas temperature; and a throttling device for at least partially blocking a flow of the exhaust gas therethrough when said temperature sensor senses that the exhaust gas temperature has exceeded a set temperature.

18. The apparatus of claim 17 further comprising an electronic control unit responsive to said temperature sensor for actuating one said throttling device when the set temperature in the corresponding outlet of the respective section is exceeded.

19. The apparatus of claim 17 wherein the exhaust gas tract has plural portions and wherein each of said filter sections is in a separate one of the plural portions.

20. The apparatus of claim 17 wherein all of the exhaust gas from the diesel engine flows through said filter sections.

* * * * *